United States Patent [19]

Peralta et al.

[11] 4,150,422

[45] Apr. 17, 1979

[54] ARMORED LIGHT PROJECTOR

[76] Inventors: Enrique B. Peralta; Julio A. Benes, both of Roger Balet 104 - Sur, San Juan, Argentina

[21] Appl. No.: 846,200

[22] Filed: Oct. 27, 1977

[30] Foreign Application Priority Data

Oct. 28, 1976 [AR] Argentina ..... 265265

[51] Int. Cl.[2] ..... F21M 1/00; F21M 7/00; F21P 1/00; F21V 13/04; F21V 17/00; F21S 3/00

[52] U.S. Cl. ..... 362/218; 89/1 R; 89/36 H; 362/223; 362/263; 362/276; 362/294; 362/296; 362/298; 362/299; 362/300; 362/301; 362/302; 362/364; 362/369; 362/376; 362/378; 362/390

[58] Field of Search ..... 89/1 R, 36 H; 362/390, 362/296, 376, 378, 369, 276, 263, 217, 218, 223, 294, 298, 299, 300, 301, 302, 364

[56] References Cited

U.S. PATENT DOCUMENTS

| | | | |
|---|---|---|---|
| 3,354,343 | 11/1967 | Myers | 362/217 |
| 3,404,886 | 10/1968 | Dundr | 362/296 |
| 3,468,218 | 9/1969 | Schimmelpfenning | 89/36 H |
| 4,027,151 | 5/1977 | Barthel | 362/217 |

FOREIGN PATENT DOCUMENTS

| | | | |
|---|---|---|---|
| 1224612 | 6/1960 | France | 362/296 |
| 593481 | 2/1934 | Fed. Rep. of Germany | 362/296 |
| 513244 | 2/1955 | Italy | 362/296 |
| 357369 | 3/1938 | Italy | 362/296 |

*Primary Examiner*—Benjamin R. Padgett
*Assistant Examiner*—T. S. Gron
*Attorney, Agent, or Firm*—Fleit & Jacobson

[57] ABSTRACT

An armored light projector is provided, having a linear light source arranged at the focal axis of a reflector unit capable of projecting a light beam of parallel rays having a substantially rectangular cross-section, the light source being mounted in a rear bottom recess of the reflector unit such as not to be directly visible from the front of the projector. The recess within which the light source is mounted is shielded by an armor assembly against direct impact of a projectile aimed at the front or at the sides of the projector. The projector has shock-absorbing suspension means capable of supporting the linear light source and affording means allowing its connection to a suitable external electric power supply. Means may be provided for protecting the rear and the top of the reflector unit against shocks and or blows, and means may be also provided for improving the cooling of the projector. At the frontal light beam output opening of the reflector unit a refractor unit may be provided to improve the directionality of the light beam rays.

16 Claims, 7 Drawing Figures

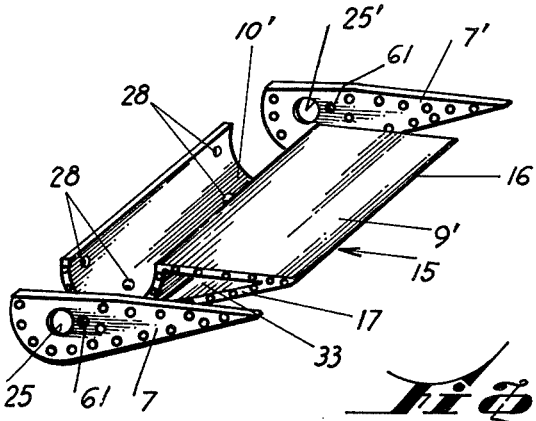
Fig. 4
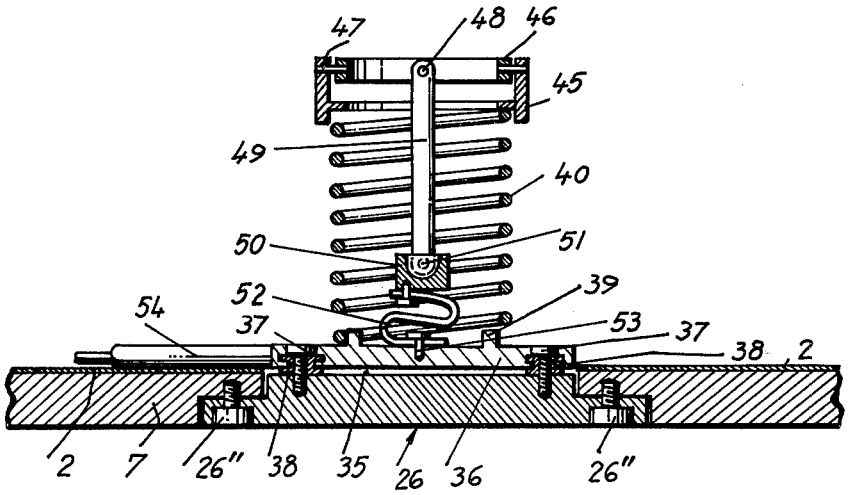
Fig. 6
Fig. 7
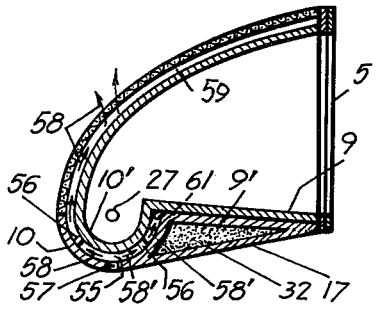

ARMORED LIGHT PROJECTOR

FIELD OF THE INVENTION

This invention relates to an armored light projector of new design and more particularly to an armored light projector which has been specially designed to protect its light source against the impact of projectiles.

BACKGROUND OF THE INVENTION

Military and policial actions, specially actions carried out during night time, require the use of strong light sources which are able to project intense light beams capable of illuminating objects situated at comparatively long distances.

However, within the knowledge of the applicants, all the light projectors used until now have light sources which are completely vulnerable to the impact of all kind of projectiles (from firearms, throwed stones or other objects having high inertia). Once the light source of the projector has been hit and destroyed, the light projector becomes a useless instrument, and this fact may jeopardize the entire military or policial action and the life of the men participating in the action may be put in danger.

Thus it would be highly desirable to provide a powerful light projector incorporating a light source protected against the impact of projectiles and which could be used as a fixed or as a portable projector and which consequently could not be put out of action by the discharge of firearms of the enemy.

SUMMARY OF THE INVENTION

Thus, it is a general object of the invention to provide a light projector of new design.

A more specific object is to provide a light projector of new design which has a powerful light source which is enterely protected against direct impacts of projectiles aimed thereon.

Another object is to provide a light projector of the kind mentioned which can be used as a fixedly mounted projector or as a portable instrument.

A still further object is to provide a light projector of the kind mentioned which is of comparatively reduced weight and which can be manufactured at a substantially low cost.

Another object is to provide a light projector of the kind mentioned which can be manufactured so as to be able to use any of the commonly known light generating sources, such as mercury, iodine or sodium tubes or lamps, or even an incandescent filament tubular lamp.

Thus the invention provides a light projector having a linear light source, characterized by having a light reflector unit comprising a light housing member forming a substantially semicylindrical cavity transversely extending across the lower rear portion of the projector and having a reflecting inner surface, shock-absorbing suspension means for supporting said linear light source centered within said cavity along the longitudinal axis thereof and having sockets receiving the ends of said linear light source for connecting it to a suitable external electric power supply, two reflecting members each integrally extending from the corresponding longitudinal edges of said light housing member, the lower one of said reflecting members extending straightly towards the front of said projector and the upper one being curved and having a radius increasing towards said front of the projector, forming a reflector structure directing the light rays of said linear light source into a concentrated beam of substantially parallel rays directed towards the front of the projector and having a substantially rectangular cross-section, two side structural members fixed to each side of the light reflector unit and closing the lateral openings thereof, and armor means arranged in front and at the sides of said linear light source and capable of shielding it against impacts of projectiles aimed at said projector.

BRIEF DESCRIPTION OF THE DRAWINGS

In order to facilitate the comprehension of the present invention, a specific embodiment thereof, which at present is considered as a preferred embodiment, will be described with reference to the accompanying drawings, in which:

FIG. 4 illustrates an exploded view of the elements constituting the armor protecting the light source;

FIG. 6 shows a longitudinal cross-sectional of one of many possible shock-absorbing lamp mounting means which may be used in the light projector of this invention; and FIG. 7 shows a longitudinal cross-section of a modification of the embodiment of FIG. 3 which provides a better cooling action of the light source.

In the several figures the same reference numerals have been used to identify the same or equivalent parts.

DESCRIPTION OF PREFERRED EMBODIMENTS OF THE INVENTION

Figure 1:
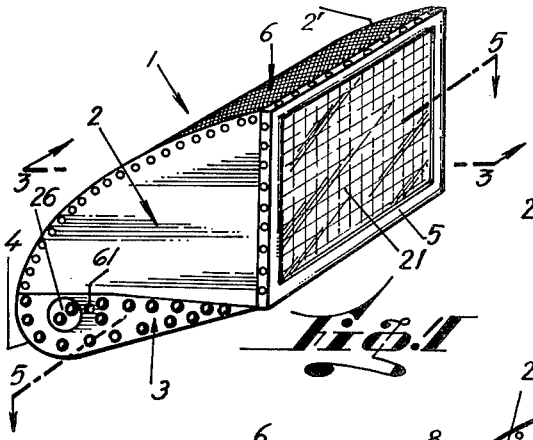
FIG. 1 is a lateral prospective view of the projector of the present invention.

Referring now to the drawings, it can be seen that the light projector 1 of this invention comprises in general side members 2 and 2' of which only one is visible in its enterity in FIG. 1 (side member 2). This side member has a substantially straight bottom portion 3 merbinb with a substantially curved portion 4—4' of variable radius generally increasing in clockwise direction.

The law of variation of the radius of the curved portion 4—4' depends of course on the angular aperture of the light beam which is desired.

The front of the light projector includes a frontal frame 5 which is associated with other members as will be explained later on. The upper and rear portions of the projector are protected with a protecting cover 6 which may be a thick wire mesh or any other reinforcing framework capable of mechanically protecting the projector but which at the same time offers substantially no resistance to the piercing by a projectile aimed at the front of the projector. Over the lower portion of each side member 2 is applied a side armor plate 7.

Figure 2:
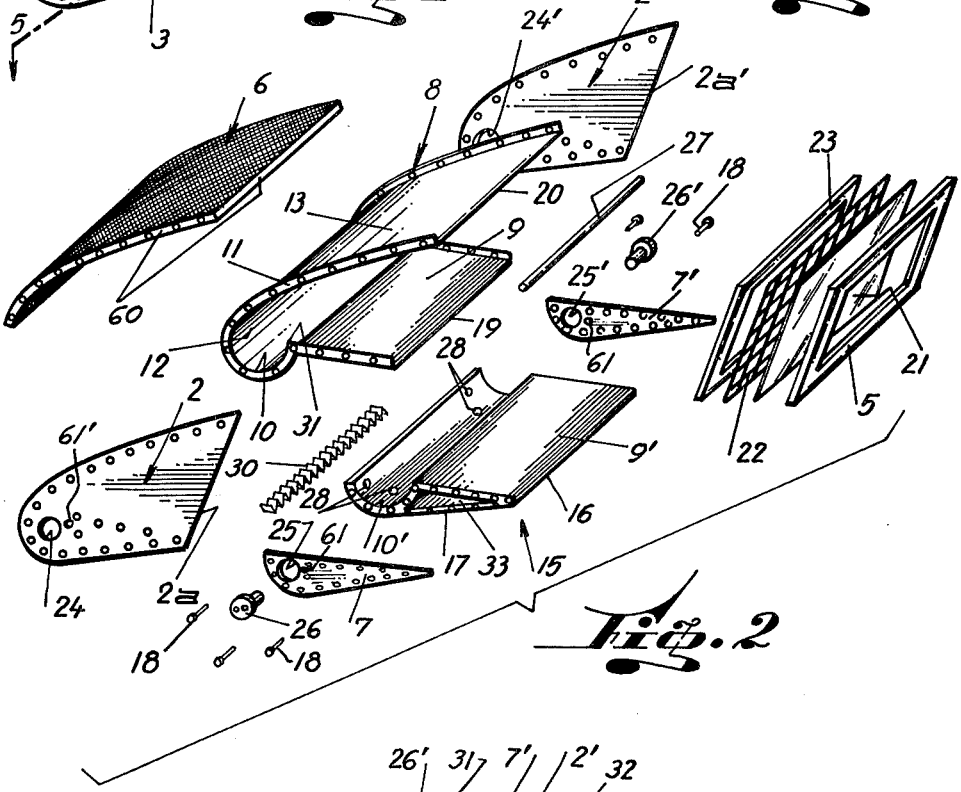
FIG. 2 is an exploded view of the elements constituting the complete light projector.

FIG. 2 shows an exploded view of the light projector of FIG. 1. The main member of the projector is a reflector member 8 which has a special curved shape. The bottom of reflector 8 has a first straight plane portion 9 followed by an substantially semicylindrical portion 10 merging with a curved portion 11 of variable radius which in general extends above the straight plane portion 9. This reflector member is made of a perforable and infrangible material such as aluminum. The entire inner surface 12 of the reflector member 8 may be mirror-like polished or may have applied a mirror-like coating to improve its reflecting properties.

To the upper and rear surface 13 of reflector member 8 may be applied to protecting cover 6 capable of mechanically protecting the reflector against blows, shocks and the like. Cover 6 may be made of a heavy wire mesh or a metallic or plastic material grating or grill-work.

To the bottom of reflector member 8 is applied an armor assembly 15 comprising a substantially cylindrical portion 10' which may have substantially the same shape as portion 10 of the reflector member 8 or may have a slightly different contour. Its frontal edge extends into a straight plane portion 9' similar in shape to the straight plane portion 9 of reflector member 8. To the frontal edge 16 of the straight plane portion 9' is soldered or fixed by any other suitable means another straight member 17 which at its other end is fixed (p.e. by soldering) to the bottom surface of cylindrical portion 10'. The armor assembly 15 is made of heavy iron or steel sheet capable of resisting and deflecting projectiles of comparatively heavy caliber. The entire armor assembly 15 is applied against the external bottom surface of reflector member 8.

To the corresponding sides of the unit considered by the reflector member 8, protecting cover 6 and armor assembly 15 are applied the side members 2 and 2', respectively. To the external faces of side members 2 and 2' are applied the side armor members 7 and 7' which have a profile resembling the lateral profile of the forward portion of armor assembly 15, laterally covering also the ends of the cylindrical portion 10'.

To the unit comprising reflector member 8, protecting cover 6 and armor assembly 15, the side members 2 and 2' and the side armor plates 7 and 7' are applied by means of rivets 18, by soldering or by any other suitable means.

To the front of the substantially rectangular aperture defined between the frontal edge 19 of straight portion 9 and the frontal edge 20 of the upper portion 13 of reflector member 8, and the frontal edges 2a and 2a' of side members 2 and 2' respectively, the frontal frame 5 is fixed. Frame 5 may support a refractor assembly comprising a sheet 21 of transparent material, such as borosilicate glas which may have a refracting pattern capable of forming a beam having desired characteristics of directionality. Glass sheet 21 may be backed with a protecting wire mesh 22 and the assembly may be provided with a rear gasket 23.

Side members 2 and 2', and side armor plates 7 and 7', are provided with corresponding apertures 24 and 24', and 25 and 25', respectively, which are all axially aligned with the focal axis of reflector member 8. Plug-type members 26 and 26' may be fixed into the apertures 35 and 25' of side armor plates 7 and 7' in a manner which will be better explained with reference to FIG. 6.

Figure 3:
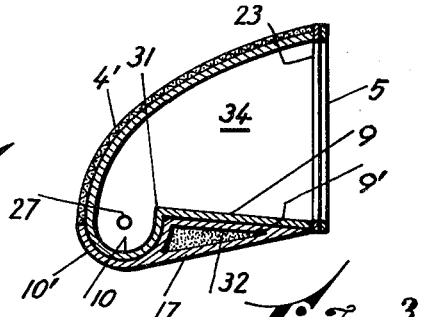
FIG. 3 is a longitudinal cross-section as indicated by line III—III of FIG. 1.
Figure 5:
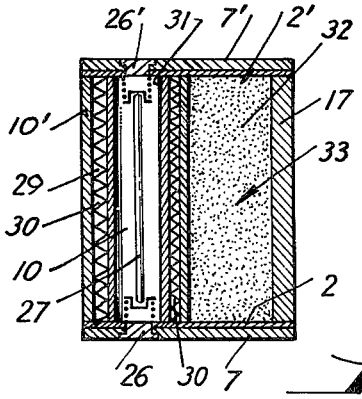
FIG. 5 is a horizontal cross-section as indicated by line V—V of FIG. 1.

The linear light source 27 has been illustrated in FIGS. 2, 3 and 5 as a tubular lamp such as an incandescent lamp (with or without halogen vapor) or a gaseous discharge tube 27. The mounting means of tube 27 within the semicylindrical portion 10 of reflector member 8 will be described in detail with reference to FIG. 6.

Since the semicylindrical portion 10 of reflector member 8 may become substantially heated by tube 27 during the operation of the light projector, it is convenient to provide means capable of allowing the flow of cooling air over the external surface of said portion 10. To this end the semicylindrical portion 10' may have a plurality of apertures 28 (only four have been shown on the drawings; however any number of such apertures 28 may be provided as may be required to obtain an efficient cooling action) and the semicylindrical portions 10 and 10' may be separated by a space 29 in which a plurality of metallic strips 30 folded in accordion-like fashion may be arranged. These strips 30 serve as separators which allow the flow of air between their folds and at the same time provide direct thermal contact between both semicylindrical portions 10 and 10'. Thus heat may be removed from the external surface of portion 10 by the flow of air over said surface and issuing through apertures 28, and at the same time by thermal conduction from portion 10 to portion 10' through strips 30, being removed from portion 10' both by direct radiation and by contact with the surrounding atmosphere. It will be obvious that any other efficient cooling means may be used, such as cooling fins, a blower, and the like.

FIG. 3 shows a transversal cross-section of the light projector of FIG. 1. It is important to note the arrangement of light source 27 which is situated at a horizontal plane which is below the rear edge 31 of plane portion 9 of reflector member 8.

FIG. 4 shows an exploded view of the elements constituting the armor applied to the bottom surface of reflector member 8. Observing FIG. 5 it will be obvious that the side members 2 and 2' will be interposed between the side armor plates 7—7 and the central member 15 of the armor assembly.

FIG. 5 is a plan view of a horizontal cross-section according to line 5—5 of FIG. 1 and passingh through the geometrical axis of light source 27; the arrangement of the light source 27 and of two of the folded strips 30 may be observed. In FIG. 5, and also in FIG. 3, a heavy filler material 32 is shown which fills the cavity 33 formed between the armor plates 9', 10' and 17, and the side members 2 and 2'. This filler material gives more inertia to the entire projector and will aid in absorbing the impact of a projectile hitting the projector. It may be seen that a bullet coming from the front end penetrating the space 34 (FIG. 3) within reflector member 8 through the frontal transparent plate 21 will hit the internal surface of the curved portion 4' perforating it without affecting the tubular light source 27.

To avoid the possibility of destruction of the light source 27, not by direct impact but by the shock or vibration induced by a bullet hitting other parts of the projector, a special cardanic suspension has been devised for the sockets supporting the tube. The construction of such a mounting is shown in FIG. 6. Within the aperture 25 of side armor member 7 the plug-type member 26 is fixed by means of screws 26''. On the inner face 35 of member 26 a base plate 36 is fixed by means of screws 37. If base plate 36 is made of metal, it will be isolated from member 26 and screws 37 by means of electrically isolating bushings 38. On the inner face of base plate 36 there is provided a circular ridge 39, capable of receiving therearound a helical spring 40. Upon the opposite end of spring 40 a first gimbal ring 45 is arranged, and within said ring 45 another gimbal ring 46 is pivotedly supported by means of mounting pins 47 so as to be able to rotate about a horizontal axis (as seen in FIG. 6). At two diametrically opposite points 48 of ring 46, situated on a diameter which is at right angles with the diametral direction defined by pins 47, two rods 49 (only one of which is visible in FIG. 6) are pivoted. At the opposite end of rods 49 the tube socket 50 proper is pivotally mounted at points 51. Thus socket 50 is swingably mounted on the corresponding ends of rods 49 and has three degrees of liberty of movement: the first one is around the pivot points 48 and 51 of rods 49, the second one is around the pivots 47 of ring 46, and the third one is allowed by the elasticity of spring 40 which is placed under compression when the light source tube 27 is held under pressure in position between the two sockets 50 (see FIG. 5). The diameters of the base plate 36 and spring 40, and the inner diameters of rings 45 and 46 are such as to allow the light tube to be removed and replaced by another one. To make a change of light tube, screws 26'' must be removed and then the entire tube mounting assembly may be withdrawn through apertures 24 and 25. Thereafter the light tube proper may be removed, also through said apertures 24 and 25 and may be replaced by a new one which will be plugged into socket 50 of the other tube mounting assembly (the one which has not been removed) after which the previously disassembled tube mounting unit will be replaced, the corresponding end of the light tube passing through the inner aperture of rings 45 and 46 and the middle of spring 40 and finally plugging it into socket 50. Thereafter the plug-type member 26 is fixed to the side member 2 by means of screws 26''. Electrical connection between the light source 27 and an external electric energy supply source (not shown) is made by means of a flexible conducting strip or wire 52 one end of which is connected to the metal cap within socket 50 receiving the corresponding end of the light tube 27, the other end being connected to a screw 53 fixed on the base plate 36. A lead-in wire 54 connects screw 53 with an external source of electrical power.

It is worth mentioning that it is possible to add to the projector of this invention auxilliary cooling means such as cooling fins provided on the external surface of the substantially semicylindrical portion 10', or to use forced cooling air flow by means of an externally applied cooling fan.

FIG. 7 shows a cross-section similar to FIG. 3, but corresponding to an embodiment which allows a better cooling of the light source housing member of the projector. The internal surface of the substantially semicylindrical portion 10' of the armor assembly 15 has a radius slightly greater than the radius of the substantially semicylindrical portion 10 of the reflector unit. Portion 10' is so mounted as to leave a space 55 between both portions 10 and 10'. Between these portions may be arranged any suitable type of spacers 56 (only two are schematically shown on FIG. 7, but any number of such spacers may be arranged between both portions 10 and 10'); however, spacers 56 must be such as to allow the free flow of air therebetween. At the bottom of portion 10' there are suitably provided a plurality of apertures 57 allowing the input of air which may flow through space 55 (as indicated by the arrows 58 and 58'). The air may flow from apertures 57 to the left (as seen on FIG. 7) through space 55 and emerge to the surrounding atmosphere through wire mesh 6 which is mounted on the back 13 of the reflector member 8 so as to leave a continuous spacing 59 therebetween. To this end the wire mesh 6 may be provided with a peripherical down-turned flange 60 by means of which it is mounted on the back 13 of reflector member 8 so as to leave therebetween said space 59.

Air entering through apertures 57 may also flow to the right (as seen on FIG. 7), flow through the space 55 and reach the end thereof closed by the straight plane portion 9 of the reflector unit. At this region there are provided in each side member 2 and 2', and in each side armor plate 7 and 7' corresponding lateral apertures 61 and 61' in such a manner that aperture 61 of side armor plate 7 is aligned with aperture 61' of side member 2, the same being true for the apertures 61 and 61' of side armor plate 7' and side member 2'. Thus air flowing to the right (arrows 58' in FIG. 7) through space 55 may issue through lateral apertures 61 and 61' (apertures 61' of side member 2' is not visible in FIG. 2).

The light projector of this invention may be used as a portable unit or as a fixed unit. In the first instance the projector may be provided with any conventional type of handle and in the second instance it may mounted on a stand or it may be fixed on the upper edge of a wall or it may be imbeded into a recess of a wall or any other masonry work. The light source is virtually indestructible by bullets or other projectiles aimed at it from a point situated in front of the projector and following a trajectory forming any practically possible angle with the horizon.

While a certain representative embodiment and details have been shown for the purpose of illustrating the invention, it will be apparent to those skilled in the art that various changes and modifications may be made therein without departing from the spirit or scope of the invention.

We claim:

1. A light projector having a linear light source, characterized by having a light reflector unit comprising a light source housing member forming a substantially semicylindrical cavity transversely extending across the lower rear portion of the projector and having a reflecting inner surface, shock-absorbing suspension means for supporting said linear light source within said cavity substantially along a longitudinal axis thereof and having sockets receiving the ends of said linear light source for connecting it to a suitable external electric power supply, two reflecting members each integrally extending from the corresponding longitudinal edges of said light source housing member, the lower one of said reflecting members extending straightly towards the front of said projector and the upper one being curved and having a radius varying towards said front of the projector, forming a reflector structure directing the light rays of said linear light source into a concentrated beam of substantially parallel rays directed towards the front of the projector and having a substantially rectangular cross-section, two side closure members fixed to each side of the light reflector unit and closing the lateral openings thereof, and armor means arranged at least in front, at the sides and at the bottom of said light source housing member and capable of shielding said light source against impacts of projectiles aimed at said projector.

2. A light projector according to claim 1, wherein said armor means comprises a first armor member having a substantially semicylindrical portion, the internal surface thereof having a shape substantially resembling the shape of the external surface of the substantially semicylindrical light source housing member, and the front edge of said first armor member extending into a plane straight portion the upper surface of which is applyable against to the bottom face of said lower reflecting surface, a second armor member joining the front edge of said plane straight portion to the bottom external surface of the substantially semicylindrical portion of said first armor member, a cavity being formed between said plane straight portion and said second arm member, and corresponding side armor plates each applied against a corresponding one of said side closure members.

3. A light projector according to claim 2, wherein said cavity formed between said first and second armor members is filled with a heavy filler material.

4. A light projector according to claim 3, wherein said filler material is sand.

5. A light projector according to claim 1, wherein said linear light source comprises at least one tubular lamp.

6. A light projector according to claim 5, wherein said tubular lamp is an incandescent tubular lamp with halogen vapor.

7. A light projector according to claim 5, wherein said tubular lamp is a vapor discharge tube.

8. A light projector according to claim 1, wherein in the frontal opening of said light reflector unit a light refractor assembly is arranged, said refractor assembly comprising at least a mounting frame carrying a transparent plate.

9. A light projector according to claim 8, wherein said transparent plate is provided with a light refracting pattern.

10. A light projector according to claim 8, wherein said transparent plate is a plate of non-splintering glass.

11. A light projector according to claim 10, wherein said non-splintering glass plate is a plate of borosilicate glass.

12. A light projector according to claim 8, wherein said transparent plate has embeded therein a protecting wire mesh.

13. A light projector according to claim 8, wherein said transparent plate is backed by a reinforcing wire mesh.

14. A light projector according to claim 1, wherein the external surface of the upper one of said two reflecting members is backed by a protecting wire mesh pierceable by a projectile hitting said reflecting member.

15. A light projector according to claim 1, wherein said substantially semicylindrical portion of said first armor member, said side armor plates and said side closure members have a plurality of vent apertures therethrough and between this substantially semicylindrical portion and the substantially semicylindrical light source housing member of the light reflector unit at least one heat radiating and conducting member is arranged, the space therebetween allowing the flow of cooling air.

16. A light projector according to claim 1, wherein each said shock-absorbing means supporting a socket receiving an end of said linear light source comprises a cardanic mounting comprising a helicoidal spring having one of its ends mounted on a corresponding one of said side armor plates, a first ring fixed to the other end of said spring, a second ring pivotally mounted within said first ring so a to be capable of rotating about pivot pins provided at diametrically opposite first points of said first ring, two link rods pivotally mounted on said second ring at diametrically opposite second points thereof orthogonally related to said first points, the corresponding light source end receiving socket being pivotally mounted on the other end of both said link rods.

* * * * *